United States Patent [19]

Drake

[11] Patent Number: 4,750,883

[45] Date of Patent: Jun. 14, 1988

[54] DEVICE FOR CLEANING RAIN GUTTERS

[76] Inventor: Harry N. Drake, 418 Berkshire Rd., Fairless Hills, Pa. 19030

[21] Appl. No.: 12,451

[22] Filed: Feb. 9, 1987

[51] Int. Cl.[4] ..... A46B 11/02; A47L 13/03

[52] U.S. Cl. ..... 401/137; 401/139; 401/261; 401/289; 239/532

[58] Field of Search ..... 401/137, 139, 261, 289; 239/532

[56] References Cited

U.S. PATENT DOCUMENTS

| | | | |
|---|---|---|---|
| 1,952,477 | 3/1934 | Stich | 401/261 |
| 2,910,711 | 11/1959 | Mizelle | 401/139 X |
| 3,041,655 | 7/1962 | Entler | 401/137 X |
| 4,182,497 | 1/1980 | Ferreira et al. | 239/532 |
| 4,303,348 | 12/1981 | O'Brien | 401/137 |
| 4,304,498 | 12/1981 | George | 401/139 X |
| 4,319,851 | 3/1982 | Arthur | 401/137 |
| 4,502,806 | 3/1985 | Albertson | 401/137 |

FOREIGN PATENT DOCUMENTS

| | | | |
|---|---|---|---|
| 79099 | 9/1962 | France | 401/139 |
| 8402553 | 7/1984 | PCT Int'l Appl. | 401/139 |

*Primary Examiner*—Steven A. Bratlie

*Attorney, Agent, or Firm*—Sperry, Zoda & Kane

[57] ABSTRACT

An elongated tubular member having a valved coupling at one end to a garden hose, has an inverted J-shaped portion at its other end terminating in a hollow, paddle-like cleaning head. A user at ground level is thus enabled to extend the device into a rain gutter, and move it therealong to dislodge leaves and other debris. Water forced into the head is discharged at high velocity through small openings in the leading surface of the head, along paths calculated to aid in the dislodgement and flushing of the debris from the rain gutter. The tubular member can be sectionally constructed, so as to be extendable to selected, different lengths. The cleaning head is detachable, to permit the substitution of various cleaning heads, including, for example, a cleaning head having a plastic or rubber, resiliently deformable scraping edge, or one having a cleaning brush upon the debris-engaging edge of the head.

6 Claims, 2 Drawing Sheets

DEVICE FOR CLEANING RAIN GUTTERS

BACKGROUND OF THE INVENTION

1. Field of the Invention

The present invention relates generally to the provision of cleaning devices, and in a more particular sense relates to the provision of devices of this nature designed specifically for the purpose of extension thereof into rain gutters, by an individual who remains at ground level. In a more particular sense, the invention relates to devices of this type through which water is forced into a cleaning head that is shaped to enter the gutter and dislodge leaves or other debris therefrom. In yet a more particular sense, the invention has reference to devices of this type in which the scraping action is combined with a flushing action, resulting from a particular construction of the cleaning head that is adapted to produce high velocity, multiple jets angled directly against the debris that is to be dislodged, to aid in freeing said debris from the gutter surface and flushing the same down an associated downspout.

2. Description of the Prior Art

It is known to provide devices of the type including an elongated pole that can be manipulated by one standing on the ground, and that includes at its upper end a cleaning means adapted to be shifted along the length of a rain gutter for the purpose of dislodging leaves or other debris.

However, those patents that have heretofore been issued do not appear to suggest the provision of a hollow, paddle-like member provided with a hose coupling that is connectable directly to a garden hose, with said member having a plurality of small outlet openings through which jet streams would be directed under pressure along convergent paths, in a series spaced inwardly from the bottom, wiping edge of the paddle member.

The prior art, though teaching the broad concept of the elongated, pole-like, tubular member through which water is forced to aid in the cleaning operation, fails to suggest a structure such as described above, and as a result, nothing has been conceived, heretofore, that will produce a discharge of water either along a horizontal path spaced upwardly from and generally paralleling the bottom edge of the gutter, or at least along a path that is provided with a strong horizontal component. As a result, the prior art has failed to disclose or suggest a device wherein water will be directed forcibly against the debris along paths that tend to urge the debris in association with the wiping edge of the paddle element itself, toward a downspout.

The basic purpose of the present invention, accordingly, is to provide a device which will overcome the noted deficiencies of the prior art.

A second equally important object is to provide a device of the character described that can be manufactured at relatively low cost, since the ordinary householder will use a device of this type only at intervals, as distinguished from a regular day-to-day use. In such circumstances, it is of course desirable that the overall cost of a device of this nature be kept as low as possible, so as to be within the reach, in a financial sense, of the ordinary householder.

Yet another purpose of the present invention is to design the device in such a way as to permit it to be quickly assembled or disassembled, thereby to permit its storage, along with other garden equipment, in a relatively compact area.

It is also desirable, in a device of this type, to permit a plurality of different types of cleaning heads to be readily attachable to or detachable from the tubular support or pole member, so as to meet the needs of different situations that may be encountered, including, for example, a need of scraping off debris that is adhering strongly to the bed of the gutter, or perhaps brushing away loose, granular materials, seeds, or the like. In each instance, however, it is proposed that the particular wiping, brushing or scraping action be accompanied by multiple jets angled in the specific manner discussed previously herein.

SUMMARY OF THE INVENTION

Summarized briefly, the present invention includes an elongated, tubular pole element, one end of which has a valved coupling quickly attachable to a conventional garden hose. The other end of the pole element has an inverted J-shaped end portion, adapted to be coupled at its distal end to a cleaning head.

The cleaning head may take any of various forms, but in general is in the form of a paddle or scoop, the configuration of which corresponds generally to the cross-sectional configuration of a typical rain gutter. In this way, the scoop when entered into the rain gutter exerts a wiping action, along the side and bottom edges of the scoop, against the walls of the rain gutter, thus to dislodge leaves and other trash, and push the dislodged material toward a downspout. The scoop is angled forwardly in a direction from its top to its bottom edge, and is of hollow formation, with a generally knife-like, beveled, or sharpened bottom edge. Formed in the front surface of the scoop, in close proximity to the bottom edge thereof, is a series of jet openings, through which water will be forced under high pressure, along paths adapted to strike the debris disposed in advance of the scoop, thus dislodging the debris, or at least loosening the same so that it can be scraped free by the bottom edge of the scoop itself. The water forced from the cleaning head serves, further, to flush the dislodged material toward the downspout.

In at least one form of the invention, the bottom edge of the scoop is of semi-flexible, resilient material, such as a soft plastic or rubber, so as to exert a squeegee-like action as the scoop moves along within the gutter. In at least one other form, there is provided a brush element on the bottom edge of the cleaning head.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENTS

Figure 1:
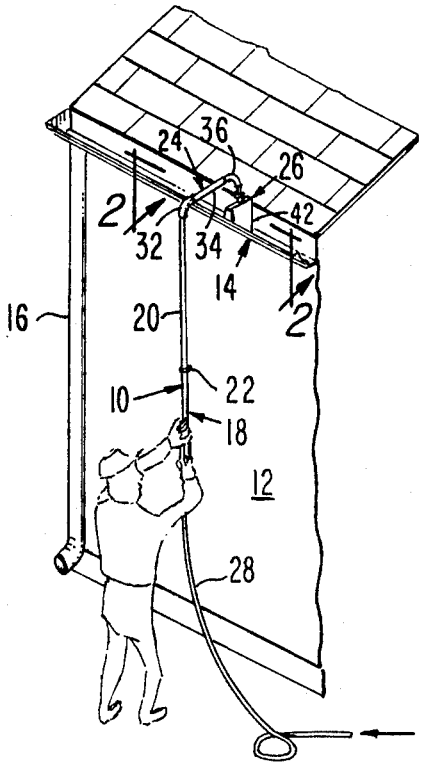
FIG. 1 is a view in which a residence is illustrated fragmentarily and in perspective, with a gutter cleaning device constructed according to the invention being illustrated in perspective as it would appear when in use.
Figure 2:
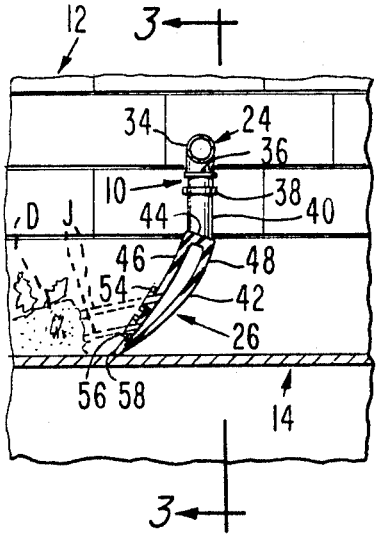
FIG. 2 is an enlarged sectional view taken substantially on line 2—2 of FIG. 1.

In FIGS. 1–5, the gutter cleaning device has been generally designated 10. A house 12 is illustrated, having a conventional gutter 14 provided at its outlet end with a downspout 16.

The cleaning device 10 includes an elongated, rigid, tubular pole 18 comprised of straight, elongated pole sections 20, 20 connected by conventional pipe couplings 22, thereby permitting the pole to made of any selected length, as dictated by the distance between the ground and gutter 14.

At its upper end, pole 18 is fixedly connected in communication with a tubular, inverted J-shaped, cleaning head support portion 24 terminating at its outlet end in a cleaning head 26 hollowly formed so as to permit water to be forced into the head under pressure and discharged at high velocity through nozzle, jet or spray openings, against debris D that is to be dislodged from and flushed out of gutter 14.

Figure 3:
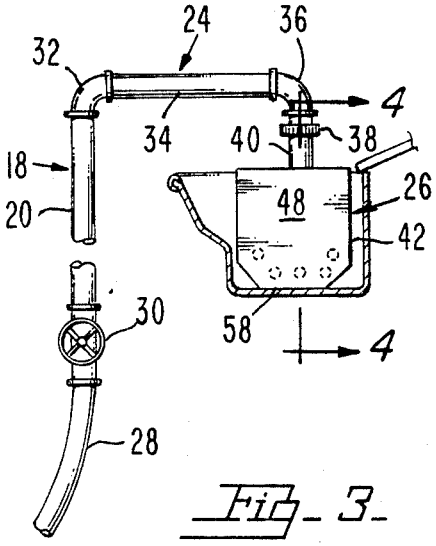
FIG. 3 is a sectional view on the same scale as FIG. 2 taken substantially on line 3—3 of FIG. 2.
Figure 5:
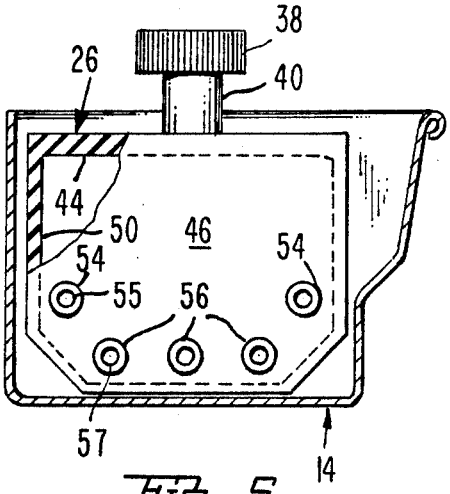
FIG. 5 is a transverse sectional view through the gutter illustrating the device in front elevation, a portion of the front wall of the device being broken away.

A conventional garden hose 28, which would be connected to a suitable garden hose faucet or the like (not shown) is connected to the inlet or lower end of pole 18 by a valved coupling 30 (FIG. 3).

At its upper end, pole 18 is connected to the cleaning head support portion 24 through the provision of an ell 32 connected to a short, horizontal pipe section 34 joined by ell 36 to a coupling 38 swivelly mounted upon the upper end of a neck 40 of head 26, the coupling 38 being molded into or otherwise fixedly secured to a paddle or scoop member 42 (FIG. 4) formed as a hollow, generally flat rubber element inclined forwardly in the direction of its lower end. The rubber, synthetic rubber, plastic, or other material of which member 46 is formed is of different thicknesses, in different areas of the member, so as to increase the flexibility of the member in the direction of its lower edge. To this end, top wall 44 thereof is thickened to an extent such as to make the top wall 44 of relatively low flexibility as compared to front and rear walls 46, 48 respectively, both of which increase in flexibility in the direction of their lower edges, by reason of being progressively reduced in thickness from the top wall 44 to the bottom edge of the paddle member 42. Side walls 50 on the paddle member are of a thickness selected so as not to inhibit the flexibility of the paddle member, particularly at the lower end thereof where a wiping action of the paddle member is utilized to scrape the debris D from the bottom of the gutter.

Figure 4:
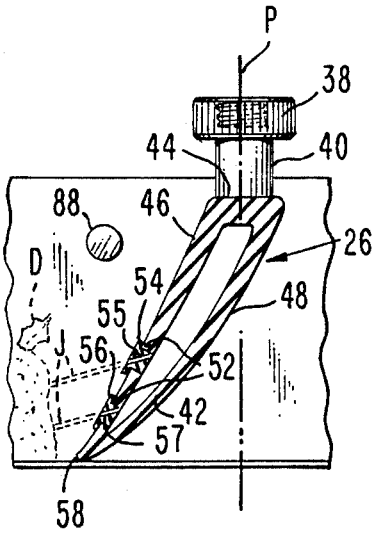
FIG. 4 is an enlarged transverse sectional view through the head of the device substantially on line 4—4 of FIG. 3.

Formed in the front wall 46 is a series of openings 52, in which there are fixedly mounted grommets 54 which can be of metallic or rigid plastic material, and which have small outlet ports or nozzle openings 55, 57 (FIG. 4) angled to discharge a plurality of jets J directly at the debris. As shown in FIG. 4, the jets J discharged at high velocity through the nozzle openings 55, 57 converge in the direction of the debris, so as to strike the accumulated trash with great force, directly in the area where the debris is to be dislodged by the cleaning head. In the illustrated example, the upper grommets 54 have nozzle openings 55 that are at a steeper angle than the lower grommets 57. This provides for convergence of the jet streams of water, whereby they strike the debris at different angles, in an impact area located just above the bottom of the gutter, but extending almost across the full width thereof.

At the lower end of the cleaning head, front walls 46, 48 extend into full convergence, and are sealably joined, so that water forced into the hollow interior of the cleaning head can be discharged only through the nozzle openings 55, 57. Due to the progressively decreasing thickness of the front and rear walls in the direction of the lower, wiping edge 58 of the cleaning head, the lower edge portion of the cleaning head is relatively highly flexible, and is inclined forwardly so as to extend knife-like in slidable contact with the bottom wall of the gutter, thereby cutting the debris loose from the gutter.

Figure 6:
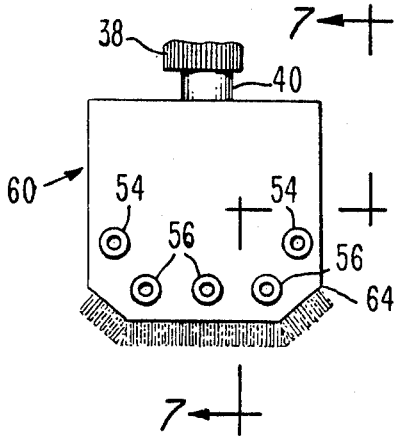
FIG. 6 is a front elevational view of a modified form of cleaning head usable in the device.
Figure 7:
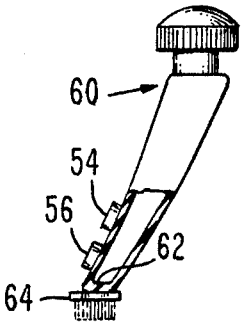
FIG. 7 is a view of the modified cleaning head of FIG. 6, partly in front elevation and partly in section, taken substantially on line 7—7 of FIG. 6.

In FIGS. 6 and 7, a modified form of cleaning head 60 is identical in all respects to the cleaning head previously described, except for the fact that the front and rear walls thereof do not extend into full convergence. Rather, they are connected, sealably, by a flat bottom wall 62 (FIG. 7) to the underside of which there is secured the back or spine of a brush 64. Head 60 can be substituted for head 26, and indeed, the cleaning device when sold could be sold with a plurality of different types of heads, any of which can be used according to the needs of the particular situation.

Figure 8:
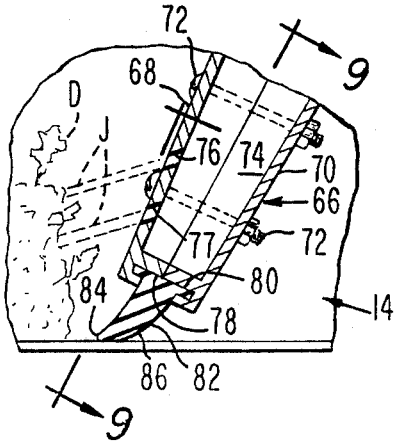
FIG. 8 is a still further enlarged, fragmentary sectional view through another modified form of the device illustrated in operative position within a gutter, the gutter being shown fragmentarily in longitudinal section.
Figure 9:
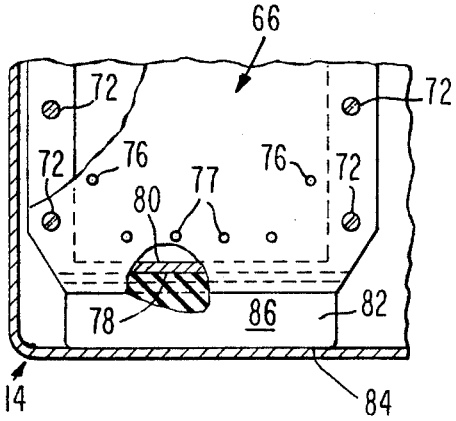
FIG. 9 is a transverse sectional view through the gutter shown in FIG. 8 taken substantially on line 9—9 of FIG. 8, illustrating the modified cleaning head of FIG. 8 fragmentarily in front elevation.

In FIGS. 8 and 9, there is shown a different form of cleaning head 66, having front and rear portions 68, 70 of rigid material, having thickened side walls formed with aligned openings receiving connecting bolts 72. The upper portion of the head 66 is not illustrated, but would be formed like those of the cleaning heads of FIGS. 1–7.

Head 66 has a hollow cavity 74, and formed in the front wall are upper and lower openings 76, 77 angled similarly to the nozzle openings 55, 57 respectively shown in FIG. 4.

At its lower end, the cleaning head 66 is formed with undercut slot 78. Slot 78 is open at its opposite ends, so that there can be slidably inserted, from either side of the cleaning head, a wiper blade having a flanged upper portion 80 engaging in the slot, and integrally formed with a body portion 82 progressively reduced in cross-section toward its lower, wiping edge 84, the flexibility of which is such as to permit it to extend knife-like between the debris D and the bottom of the gutter 14, whereby to cut the debris loose from the gutter with minimum difficulty.

Since the blade 86 shown in FIGS. 8 and 9 can be quickly engaged in or removed from the slot 78, a worn or damaged blade can be readily removed and replaced. Or, other types of wiping elements can be provided, including brushes, rigid blades, or the like, any of which can be engaged in and readily removed from the slot 78.

In use, the homeowner grasps the pole at the lower end, as shown in FIG. 1, and extends it upwardly to position the cleaning head in the gutter. He may, for example, select a location perhaps two or three feet from the downspout. The valve 30 is now opened, permitting the water under pressure to be forced through the garden hose 28 and into the pole. The water under pressure is discharged at high velocity through nozzle openings 55, 57 against the debris. At the same time, the user slowly moves the entire device in the direction of the downspout.

The streams of water discharged through nozzle openings 55, 57 in converging paths strike the debris immediately in advance of the cleaning head. This softens the debris, and tends to flush the dislodged debris in the direction of the downspout, breaking up large masses to facilitate entry into the downspout. At the same time, the movement of the entire device toward the downspout causes the knife-like, flexible bottom edge 58 to cut between the debris and the bottom wall of the gutter. The cutting action, in direct cooperation with the high velocity jet streams and flushing action, effects quick and easy dislodgment and removal of the debris from the gutter.

Thereafter, the user relocates the device perhaps another three feet away from the downspout, so as to dislodge and flush out another trash-laden area of the gutter. He may continue this procedure fully to the end of the gutter remote from the downspout.

Of course, if there appears to be no problem of a substantial pile of dislodged debris accumulating in front of the cleaning head, the user may desire to insert the cleaning head at the end of the gutter remote from the downspout, and simply move it progressively toward the downspout.

Many gutters are mounted by means of large nails 88 (FIG. 4) extending across the path of the cleaning head. The user simply lifts the cleaning head over the nails. Debris below the nails is loosened by the streams of water, and is dislodged due to the inclination of the cleaning head which extends under the nail.

It will be seen that the device thus provides a highly efficient cleaning action, combining flushing with a wiping action, in a manner to attack the debris, at all times, directly in front of the cleaning head, thereby facilitating dislodgment of the debris and flushing of the same through the downspout. One cleaning head can be readily substituted for another whenever necessary, as for example, where it is desired to remove relatively fine debris, such as particles of the roofing material. In this event, one might, for example, after dislodgment of the heavy debris, utilize the cleaning head of FIGS. 6 and 7, to brush small particles from the bottom of the gutter into the downspout while at the same time directing the jet streams of water thereagainst.

Further, one can also form the pole 18 to any length desired, through the use of the detachably connected sections 20. This also facilitates disassembly of the entire device when not in use, so as to permit it to be stored in a relatively small area.

While particular embodiments of this invention have been shown in the drawings and described above, it will be apparent that many changes may be made in the form, arrangement and positioning of the various elements of the combination. In consideration thereof it should be understood that preferred embodiment of this invention disclosed herein are intended to be illustrative only and not intended to limit the scope of the invention.

What is claimed is:

1. A device for cleaning rain gutters or the like, comprising:

(a) an elongated, tubular rigid pole including valve means at one end for connecting the same to a garden hose or the like, thereby to permit water under pressure to be forced through the pole;

(b) a rigid, tubular, cleaning head support portion detachably connected to the other end of the pole in communication therewith; and (c) a cleaning head detachably connected to the head support portion, said cleaning head being of hollow formation whereby water forced through the pole and communicating head support portion will be directed under pressure into the cleaning head, the cleaning head having forward and rear walls converging downwardly and including nozzle openings arranged for directing streams of water under pressure against debris lodged within the gutter, said cleaning head having a wiping edge at the convergent ends of the forward and rear walls below but in close proximity to the nozzle openings, whereby to exert a cutting action through the debris in close proximity to the area of said debris against which the streams forcibly discharged from the nozzles are directed, at least the wiping edge being of flexible materials, the cleaning head being inclined forwardly in a direction from the upper to the lower end thereof, said openings comprising a plurality of first openings and a plurality of second openings, the second openings being disposed between the wiping edge of the cleaning head and the first openings, the first openings being arranged to discharge water against the debris at an angle different from the angle at which the jet streams are discharged through the second openings, the angularity of the upper and lower openings being selected so as to cause the jet streams to be discharged therefrom along converging paths, the converging paths of the jet streams both extending downwardly in a direction forwardly of the cleaning head, so as to impact the debris at a location in close proximity to the bottom of the gutter, whereby to facilitate cutting of the debris loose from the gutter, by the cleaning head.

2. A device for cleaning gutters as in claim 1, wherein said wiping edge comprises a brush member secured to the cleaning head, in position to exert a brushing action against the bottom wall of said gutter.

3. A device for cleaning gutters as in claim 1 wherein the cleaning head is formed with a retention slot, and wherein said wiping edge comprises a tapered blade removably engaged in said slot.

4. A device for cleaning gutters as in claim 3 wherein the cleaning head comprises separately connected, rigid front and rear wall sections cooperating, when connected, to define said slot.

5. A device for cleaning rain gutters as in claim 1 wherein the cleaning head is formed wholly of a flexible material, said forward and rear walls being progressively reduced in thickness so as to increase flexibility of the cleaning head from one end thereof to its other end.

6. A device for cleaning rain gutters as in claim 5 wherein said front and back walls of the cleaning head are of minimum thickness at the wiping edge thereof, and are integral with and are sealably joined at said wiping edge, so as to form said wiping edge of maximum flexibility and in a knife-like configuration, thereby to facilitate cutting the debris from the gutter below the jet streams forced through the front wall of the cleaning head.

* * * * *